US009589436B2

(12) United States Patent
Herman et al.

(10) Patent No.: US 9,589,436 B2
(45) Date of Patent: Mar. 7, 2017

(54) SYSTEMS AND METHODS FOR ANNOUNCING LOCATION OF UNAUTHORIZED PARTY

(71) Applicant: Google Inc., Mountain View, CA (US)

(72) Inventors: Kenneth Louis Herman, San Jose, CA (US); Bryan James, Menlo Park, CA (US); Marty Lev, San Ramon, CA (US)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 14/721,465

(22) Filed: May 26, 2015

(65) Prior Publication Data

US 2016/0351032 A1 Dec. 1, 2016

(51) Int. Cl.

| | |
|---|---|
| ***G08B 13/00*** | (2006.01) |
| ***G08B 13/22*** | (2006.01) |
| ***G08B 3/00*** | (2006.01) |
| ***G08B 25/00*** | (2006.01) |

(52) U.S. Cl.

CPC ..... *G08B 13/22* (2013.01); *G08B 3/00* (2013.01); *G08B 25/007* (2013.01); *G08B 25/008* (2013.01); *G08B 25/009* (2013.01)

(58) Field of Classification Search

CPC ... H04W 64/00; G08B 25/007; G08B 25/008; G08B 25/009; G08B 3/00

USPC ..... 340/541, 506, 514

See application file for complete search history.

(56) References Cited

U.S. PATENT DOCUMENTS

| | | | | |
|---|---|---|---|---|
| 4,725,818 | A | 2/1988 | Motyka et al. | |
| 4,918,717 | A | 4/1990 | Bissonnette et al. | |
| 5,736,927 | A | 4/1998 | Stebbins et al. | |
| 6,400,265 | B1 | 6/2002 | Saylor et al. | |
| 6,417,769 | B1 | 7/2002 | Jan et al. | |
| 6,624,750 | B1 * | 9/2003 | Marman | G08B 25/009 340/506 |
| 6,970,082 | B2 | 11/2005 | Reese et al. | |
| 7,075,444 | B2 | 7/2006 | Tanguay et al. | |
| 7,161,479 | B2 * | 1/2007 | Sobol | G08B 13/19621 340/506 |

(Continued)

FOREIGN PATENT DOCUMENTS

EP 0063876 A1 11/1982

OTHER PUBLICATIONS

"First Alert SCO7CN Carbon Monoxide and Smoke Detector with Voice", First Alert SCO7CN Carbon Monoxide and Smoke Detector With Voice; Infrared Alarm at Smarthome; pp. 1-3 http://home-automation.smarthome.com/smarthome/Infrared-Alarm.

(Continued)

*Primary Examiner* — John A Tweel, Jr.

(74) *Attorney, Agent, or Firm* — Morris & Kamlay LLP

(57) ABSTRACT

A security system includes a plurality of sensors to detect entry into a premises by an unauthorized party and to detect a location of the unauthorized party through at least a portion of the premises, a storage component to store a log of the detected location of the unauthorized party, an audio component to audibly announce the detected location of the unauthorized party, and a processor to control the audio component to announce the detected location at predetermined intervals or upon a change in the detected location of the unauthorized party.

24 Claims, 7 Drawing Sheets

(56) References Cited

U.S. PATENT DOCUMENTS

| | | | | |
|---|---|---|---|---|
| 7,535,352 | B2 * | 5/2009 | Sobol | G08B 13/19621 340/506 |
| 8,611,321 | B2 * | 12/2013 | Herrala | G01S 1/68 370/338 |
| 2009/0224912 | A1 * | 9/2009 | Sobol | G08B 13/19621 340/541 |
| 2012/0092502 | A1 | 4/2012 | Knasel et al. | |
| 2012/0126978 | A1 | 5/2012 | Kellen et al. | |
| 2014/0266764 | A1 | 9/2014 | Henrie | |

OTHER PUBLICATIONS

Debartolo, "Smoke Alarms that announces where the smoke is.", Smoke Alarms That Announces Where the Smoke Is, Dick DeBartolo, May 23, 2011; http://gizwizbiz.squarespace.com/world-news-now-abc/2011/5/23/smoke-alarms-that-announces-where-the-smoke-is.html, May 23, 2011.

Extended European Search Report dated Aug. 17, 2016 as received in Application No. 16171259.1.

* cited by examiner

| Time | A | B | C | U |
|---|---|---|---|---|
| 11:03:00 PM | Master Bedroom | Bedroom 1 | Den | Living Room |
| 11:03:05 PM | Master Bedroom | Bedroom 1 | Unknown | Living Room |
| 11:03:10 PM | | | | |
| 11:03:15 PM | | | | |
| 11:03:20 PM | | | | |
| 11:03:25 PM | | | | |
| 11:03:30 PM | | | | |
| | | | | |
| | | | | |

FIG. 6

| Time | A | B | C | U |
|---|---|---|---|---|
| 11:03:00 PM | Master Bedroom | Bedroom 1 | Den | Living Room |
| 11:03:05 PM | Master Bedroom | Bedroom 1 | Unknown | Living Room |
| 11:03:10 PM | Master Bedroom | Bedroom 1 | Bedroom 2 | Kitchen |
| 11:03:15 PM | Master Bedroom | Bedroom 1 | Bedroom 2 | Exit Rear Door |
| 11:03:20 PM | | | | |
| 11:03:25 PM | | | | |
| 11:03:30 PM | | | | |
| | | | | |
| | | | | |

FIG. 8

SYSTEMS AND METHODS FOR ANNOUNCING LOCATION OF UNAUTHORIZED PARTY

BACKGROUND

Homes, offices, and other buildings may be equipped with smart networks to provide automated control of devices, appliances and systems, such as heating, ventilation, and air conditioning ("HVAC") system, lighting systems, home theater, entertainment systems, as well as security systems. Various control features of such systems may be accessible via mobile devices, such as a mobile control panel or a mobile computing device, e.g., a cell phone, tablet computer, or personal data assistant. Security systems may include an alarm feature that warns authorized occupants of the entry or attempted entry of an unauthorized party.

BRIEF SUMMARY

According to an embodiment of the disclosed subject matter, a system includes a plurality of sensors to detect entry into a premises by an unauthorized party and to detect a location of the unauthorized party through at least a portion of the premises, a storage component to store a log of the detected location of the unauthorized party, an audio component to audibly announce the detected location of the unauthorized party, and a processor to control the audio component to announce the detected location at predetermined intervals or upon a change in the detected location of the unauthorized party.

According to another embodiment of the disclosed subject matter, a method of operating a security system, includes detecting an entry of an unauthorized party into a premises, detecting a location the unauthorized party in at least a portion of the premises, storing a log of the detected location of the unauthorized party, and audibly announcing the detected location of the unauthorized party at predetermined intervals or upon a change in the detected location of the unauthorized party.

According to an embodiment of the disclosed subject matter, means for operating a security system are provided, including means for detecting an entry of an unauthorized party into a premises, means for detecting a location the unauthorized party in at least a portion of the premises, means for storing a log of the detected location of the unauthorized party, and means for audibly announcing the detected location of the unauthorized party at predetermined intervals or upon a change in the detected location of the unauthorized party.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

FIG. 6 shows an example log of location data according to an embodiment of the disclosed subject matter.

FIG. 8 shows another example log of location data according to an embodiment of the disclosed subject matter.

DETAILED DESCRIPTION

Figure 1:
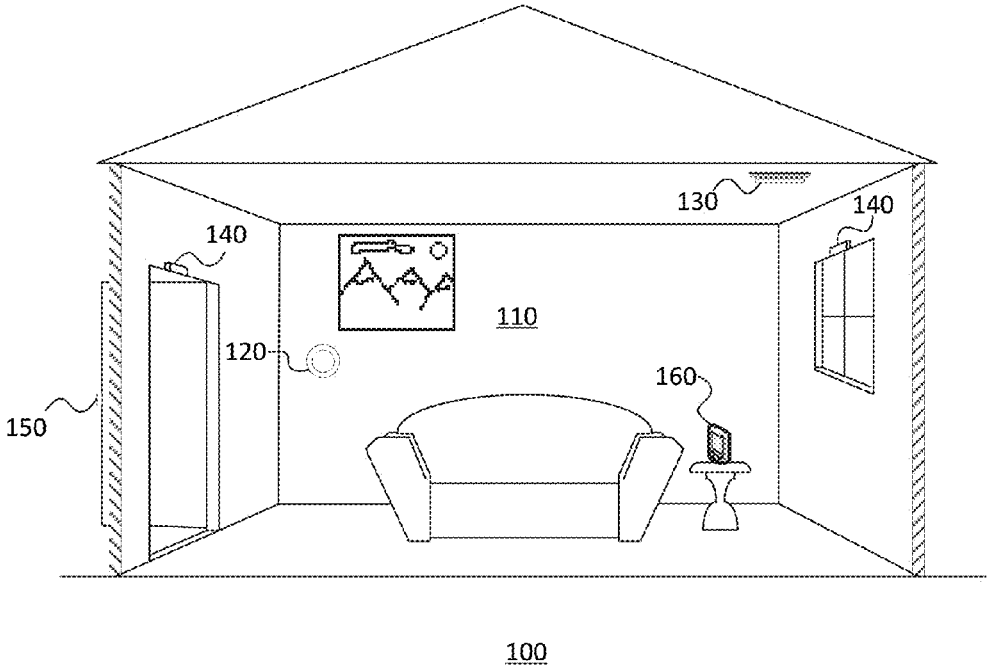
FIG. 1 shows an example premises management system according to an embodiment of the disclosed subject matter.

Various aspects or features of this disclosure are described with reference to the drawings, wherein like reference numerals are used to refer to like elements throughout. In this specification, numerous details are set forth in order to provide a thorough understanding of this disclosure. It should be understood, however, that certain aspects of disclosed subject matter may be practiced without these specific details, or with other methods, components, materials, etc. In other instances, well-known structures and devices are shown in block diagram form to facilitate describing the subject disclosure.

The disclosed subject matter relates to a security system of a premises, such as a security system integrated in a smart home environment that includes sensors, interface components and one or more processing units that process data generated by the sensors and that control the interface components. Data from the sensors may be used to determine the occurrence of a security breach or security related event, such as entry through a window of the premises, lengthy presence of an individual in an unusual location at an unusual time, or tampering with a lock of a door of the premises, etc. Upon the occurrence of such an event, the security system may determine based on any of various algorithms that an alarm is warranted and enter into an alarm mode, which may include automatically notifying a third party monitoring service as well as operating components of the system to provide visual and/or audible alerts, such as a siren sound, repeated beeping sound or flashing lights. However, while visual/audible alerts may notify authorized occupants of a potential security breach, the typical repeated beeping sound of a conventional security system alarm does nothing to warn the authorized occupants of where the breach occurred or what has transpired since. Conventional security systems also do not inform the authorized occupant of the location of other authorized occupants after a security breach as occurred.

Implementations of the disclosed security system may determine where a security breach has occurred and thereafter track the location of the unauthorized party, as well as the locations of authorized parties within and/or around the premises. In addition, in view of the high stress levels that may accompany experiencing an unauthorized intrusion, the disclosed security system may announce the location of the security breach and the location of the unauthorized party within the premises. In so doing the authorized occupants are automatically warned of which locations in/around the premises to avoid and the unauthorized party is simultaneously deterred from further advance due to the clear notice to the unauthorized party that he/she is being tracked. Alternatively, the location of the unauthorized party may be announced only to select devices so as to inform an authorized user while leaving the unauthorized party unaware that he/she is being tracked.

The presently disclosed security system may function as a subsystem of a smart facility network system and may incorporate a plurality of electrical and/or mechanical components, including intelligent, sensing, network-connected devices that communicate with each other and/or may communicate with a central server or a cloud-computing system to provide any of a variety of security (and/or environment) management objectives in a home, office, building or the like. Such objectives, which may include, for example, managing alarms, notifying third parties of alarm situations, managing door locks, monitoring the premises, etc., will collectively be referred to as "premises management."

A premises management system as discussed herein may further include other subsystems that communicate with each other to manage different aspects of premises management as well as security. For example, while a security subsystem may manage the arming, disarming, and activation of alarms and other security aspects of the premises, a smart home environment subsystem may handle aspects such as light, temperature, and hazard detection of the premises. Overall, the disclosed premises management system may leverage data obtained in one subsystem to improve or expand the functionality of another subsystem.

The disclosed security system may be operable to function in any of various modes or states. For example, security system modes may include "stay", "away" and "home" modes. In a "stay" mode the security system may operate under the assumption that authorized parties are present within the premises but will not be entering/leaving without notifying the system; therefore data from certain interior sensors may be given lower weight in determining whether an unauthorized party is present. In an "away" mode the security system may operate under the assumption that no authorized parties are in the premises; therefore data from all sensors, interior and exterior, may be accorded high weight in determining whether an unauthorized party is present. In a "home" mode the security system may operate under the assumption that authorized parties are within the premises and will be freely entering/leaving the premises without notifying the system; therefore data from certain sensors interior and exterior may be accorded low weight in determining whether an unauthorized party is present. It should be understood that these modes are merely examples and may be modified, removed, or supplemented by other modes without departing from the scope of the present disclosure.

In addition, the security system may function in any of various alarm states. For example, in a "green" or "low" alarm state the security system may operate under the assumption that all is well and no unauthorized parties have been detected within/around the premises. In a "yellow" or "medium" alarm state the security system may operate under the assumption that an unauthorized party is potentially present in or around the premises. In this state certain sensor data may be analyzed differently or additional confirmations of authorization, such as entering a code, may be required of to avoid escalation to a higher alarm state. In a "red" or "high" alarm state the security system may operate under the assumption that an unauthorized party has been detected on the premises and preventive measures may be taken, such as notifying a third party monitoring service and/or activating an alarm and announcement, as will be described later. It should be understood that greater or fewer gradients of alarm state may be included without departing from the scope of the present disclosure. Hereinafter, a heightened alarm will refer to an alarm state above the low alarm state.

The presently disclosed security system may be implemented as a stand-alone system or, as mentioned above, as a subsystem of a larger premises management system and may leverage data therefrom. For illustrative purposes and to demonstrate the cross use of data among systems, the disclosed security system will be described below as part of a premises management system, e.g., a smart home network environment.

The individual hardware components of the premises management system that are used to monitor and affect the premises in order to carry out premises management will hereinafter be referred to as "premises management devices." The premises management devices described herein include multiple physical hardware and firmware configurations, along with circuitry hardware (e.g., processors, memory, etc.), firmware, and software programming that are capable of carrying out the presently described methods and functions of a premises management system. The premises management devices may be controlled by a "brain" component, as described below, which may be implemented in a controller device or in one or more of the premises management devices.

FIG. 1 shows an example premises management system 100, installed within a premises 110. The system 100 may implement subsystems, including the disclosed security system, by using multiple types of premises management devices, such as one or more intelligent, multi-sensing, network-connected thermostats 120, one or more intelligent, multi-sensing, network-connected hazard detection units 130, one or more intelligent, multi-sensing, network-connected entry detection units 140, one or more network-connected door handles 150, and one or more intelligent, multi-sensing, network-connected controller devices 160. Data from any of these devices may be used by the security system as disclosed herein, as well as for the devices' respective primary functions.

At a high level, the system 100 may be configured to operate as a learning, evolving ecosystem of interconnected devices. New premises management devices may be added, introducing new functionality, expanding existing functionality, or expanding a spatial range of coverage of the system. Furthermore, existing premises management devices may be replaced or removed without causing a failure of the system 100. Such removal may encompass intentional or unintentional removal of components from the system 100 by an authorized user, as well as removal by malfunction (e.g., loss of power, destruction by intruder, etc.). Due to the dynamic nature of the system, the overall capability, functionality and objectives of the system 100 may change as the constitution and configuration of the system 100 change.

In order to avoid contention and race conditions among the interconnected devices, certain decisions, such as those that affect the premises management system 100 at a system level or that involve data from multiple sources, may be centralized in the aforementioned "brain" component. The brain component may coordinate decision making across the system 100 or across a designated portion thereof. The brain component is a system element at which, for example, sensor/detector states converge, user interaction is interpreted, sensor data is received, and decisions are made concerning the state, mode, or actions of the system 100. Hereinafter, the system 100 brain component will be referred to as the "primary system processor." The function of primary system processor may be implemented in the controller device 160, for example, hard coded into a single device, or distributed virtually among one or more premises management devices within the system using computational load sharing, time division, shared storage, and other techniques.

The primary system processor may be configured to control subsystems and components of the premises management system 100, such as, for example, the disclosed security system and/or a smart home environment system. Furthermore, the primary system processor may be communicatively connected to control, receive data from, and transmit data to premises management devices within the system, as well as receive data from and transmit data to devices/systems external to the system 100, such as third party servers, cloud servers, mobile devices, and the like.

In the embodiments disclosed herein, each of the premises management devices may include one or more sensors. In general, a "sensor" may refer to any device that can obtain information about its local environment and communicate that information in the form of data that may be stored or accessed by other devices and/or systems. Sensor data may form the basis of inferences drawn about the sensor's environment. For example, the primary system processor may use data from a plurality of sensors, e.g., including entry detection unit 140, to determine whether an unauthorized party is attempting enter the premises 110 through a window.

A brief description of sensors that may be included in the system 100 follows. Examples provided are not intended to be limiting but are merely provided as illustrative subjects to help facilitate describing the subject matter of the present disclosure. The system 100 may use data from the types of sensors described below in order to implement features of a security system as disclosed herein, but the present disclosure is not limited to using the types of example sensors listed here. Rather, the system 100 may employ data from any type of sensor that provides data from which an inference may be drawn about the environment in or around the premises 110. Since it would be impractical to list and describe every type of possible sensor, it should be understood that sensors in general are known in the art and deployment of sensors not specifically described herein will be readily understood by one of ordinary skill on the art.

Generally, sensors may be described by the type of information they collect. For example, sensor types may include motion, smoke, carbon monoxide, proximity, temperature, time, physical orientation, acceleration, location, entry, presence, pressure, light, and sound sensors and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof.

A sensor further may be described in terms of a function or functions the sensor performs within the system 100. For example, a sensor may be described as a security sensor when it is used to determine security events, such as unauthorized entry.

A sensor may be operated for different functions at different times. For example, system 100 may use data from a motion sensor to determine how to control lighting in the premises 100 when an authorized party is present and use the data as a factor to change a security system mode or state on the basis of unexpected movement when no authorized party is present. In another example, the system 100 may use the motion sensor data differently when a security system mode is in an "away" mode versus an "home" state, i.e., certain motion sensor data may be ignored while the system is in a "home" mode and acted upon when the system is in an "away" mode.

In some cases, a sensor may operate as multiple sensor types sequentially or concurrently, such as where a temperature sensor is used to detect a change in temperature, as well as the presence of a person or animal. A sensor also may operate in different modes (e.g., different sensitivity or threshold settings) at the same or different times. For example, a sensor may be configured to operate in one mode during the day and another mode at night. As another example, a sensor may operate in different modes based upon a mode of the disclosed security system, a state of system 100, or as otherwise directed by the primary system processor.

Multiple sensors may be arranged in a single physical housing, such as where a single device includes movement, temperature, magnetic, and/or other sensors. Such a housing may also be referred to as a sensor, premises management device or a sensor device. For clarity, sensors may be described with respect to the particular functions they perform and/or the particular physical hardware used, when such specification is beneficial for understanding of the embodiments disclosed herein.

Figure 2:
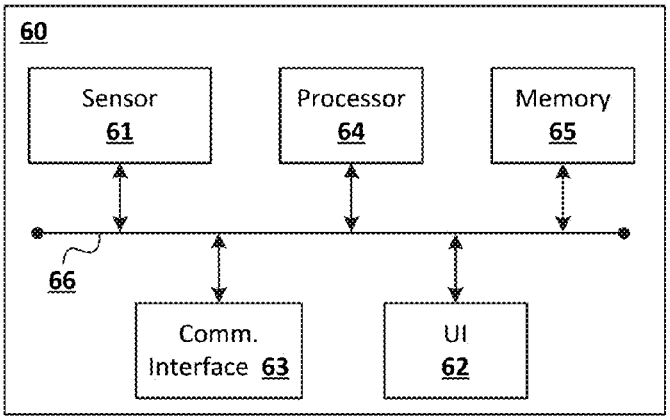
FIG. 2 shows an example premises management device according to an embodiment of the disclosed subject matter.

FIG. 2 shows an example premises management device 60 including a processor 64, a memory 65, a user interface 62, a communications interface 63, an internal bus 66, and a sensor 61 as disclosed herein. A person of ordinary skill in the art would appreciate that various components of the premises management device 60 described herein can include additional electrical circuit(s) that can incorporate components and circuitry elements of sufficient function in order to implement the embodiments of the subject disclosure. Furthermore, it can be appreciated that many of the various components listed above can be implemented on one or more integrated circuit (IC) chips. For example, in one embodiment, a set of components can be implemented in a single IC chip. In other embodiments, one or more of respective components may be fabricated or implemented on separate IC chips.

The sensor 61 may be an environmental sensor, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, compass or any other environmental sensor, that obtains or provides a corresponding type of information about the environment in which the premises management device 60 is located.

The processor 64 may be a central processing unit (CPU) or other type of processor and be communicably connected to the other components to receive and analyze data obtained by the sensor 61, transmit messages or packets that control operation of other components of the premises management device 60 and/or external devices, and process communication between the premises management device 60 and other devices. The processor 64 may execute instructions and/or computer executable components stored on the memory 65. Such computer executable components may include, for example, a primary function component to control a primary function of the premises management device 60 related to managing a premises, a communication component to locate and communicate with other compatible premises management devices, and a computational component to process system related tasks.

The memory 65 or another memory in the premises management device 60 may also be communicably connected to receive and store environmental data obtained by the sensor 61. A communication interface 63 may function to transmit and receive data using a wireless protocol, such as a WiFi, Thread, or other wireless interface, Ethernet or other local network interface, Bluetooth® or other radio interface, or the like may facilitate transmission and receipt of data by the premises management device 60 to and from other devices.

The user interface (UI) 62 may provide information and/or receive input from a user of system 100. The UI 62 may include, for example, a speaker to output an audible sound when an event is detected by the premises management device 60. Alternatively, or in addition, the UI 62 may include a light to be activated when an event is detected by the premises management device 60. The user interface may be relatively minimal, such as a liquid crystal display (LCD), light-emitting diode (LED) display, or limited-output display, or it may be a full-featured interface such as a touchscreen, keypad, or selection wheel with a click-button mechanism to enter input.

Internal components of the premises management device 60 may transmit and receive data to and from one another via an internal bus 66 or other mechanism, as will be readily understood by one of skill in the art. One or more components may be implemented in a single physical arrangement, such as where multiple components are implemented on a single integrated circuit. Premises management devices 60 as disclosed herein may include other components, and/or may not include all of the illustrative components shown.

As previously mentioned, sensor 61 obtains data about the premises, and at least some of the data may be used to implement the disclosed security system, as will be described below. Through the bus 66 and/or communication interface 63, sensor data may be transmitted to or accessible by other components of the system 100. Generally, two or more sensors on one or more premises management devices may generate data that can be coordinated by the primary system processor to determine a system response and/or infer a state of the environment. In one example, the primary system processor of the system 100 may infer a state of intrusion based on data from entry detection sensors and motion sensors and, based on the determined state, further determine whether an unauthorized party is present and a location within the premises of the unauthorized party.

Figure 3:
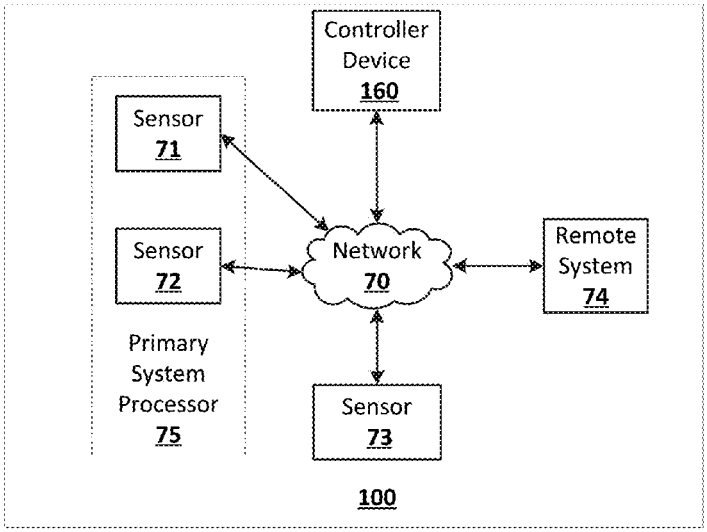
FIG. 3 shows a diagram of a premises management system that may include a security system according to an embodiment of the disclosed subject matter.

FIG. 3 shows a diagram example of a premises management system 100 which may include security system features as disclosed herein. System 100 may be implemented over any suitable wired and/or wireless communication networks. One or more premises management devices, i.e., sensors 71, 72, 73, and one or more controller devices 160 (e.g., controller device 160 as shown in FIG. 1) may communicate via a local network 70, such as a WiFi or other suitable network, with each other. The network 70 may include a mesh-type network such as Thread, which provides network architecture and/or protocols for devices to communicate with one another. An authorized party may therefore interact with the premises management system 100, for example, using the controller device 160 which communicates with the rest of the system 100 via network 70.

The controller device 160 and/or one or more of the sensors 71, 72, 73, may be configured to implement a primary system processor 75. The primary system processor 75 may, for example, receive, aggregate, and/or analyze environmental information received from the sensors 71, 72, 73, and the controller device 160. Furthermore, a portion or percentage of the primary system processor 75 may be implemented in a remote system 74, such as a cloud-based reporting and/or analysis system. The remote system 74 may, for example, independently aggregate data from multiple locations, provide instruction, software updates, and/or aggregated data to a controller 160, primary system processor 75, and/or sensors 71, 72, 73.

The sensors 71, 72, 73, may be disposed locally to one another, such as within a single dwelling, office space, building, room, or the like, or they may be disposed remote from each other, such as at various locations around a wide perimeter of a premises. In some embodiments, sensors 71, 72, 73, may communicate directly with one or more remote systems 74. The remote system 74 may, for example, aggregate data from multiple locations, provide instruction, software updates, and/or aggregated data to the primary system processor 75, controller device 160, and/or sensors 71, 72, 73. In addition, remote system 74 may refer to a system or subsystem that is a part of a third party monitoring service or a law enforcement service.

The premises management system shown in FIG. 3 may be a part of a smart-home environment which may include a structure, such as a house, office building, garage, mobile home, or the like. Of course, the devices of the smart home environment, such as the sensors 71, 72, 73, and the network 70 may be integrated into a smart-home environment that does not include an entire structure, such as a single unit in an apartment building, condominium building, or office building.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like). One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The controller device 160 may be general- or special-purpose. For example, one type of controller device 160 is a general-purpose computing device running one or more applications that collect and analyze data from one or more sensors 71, 72, 73 within the home. In this case, the controller device 160 may be implemented using, for example, a mobile computing device such as a mobile phone, a tablet computer, a laptop computer, a personal data assistant, or wearable technology. Another example of a controller device 160 is a special-purpose controller that is dedicated to a subset of functions, such as a security controller that collects, analyzes and provides access to sensor data primarily or exclusively as it relates to various security considerations for a premises. The controller device 160 may be located locally with respect to the sensors 71, 72, 73 with which it communicates and from which it obtains sensor data, such as in the case where it is positioned within a home that includes a home automation and/or sensor network. Alternatively or in addition, controller device 160 may be remote from the sensors 71, 72, 73, such as where the controller device 160 is implemented as a cloud-based system that communicates with multiple sensors 71, 72, 73, which may be located at multiple locations and may be local or remote with respect to one another.

Sensors 71, 72, 73 as disclosed herein may communicate with each other, the controller device 160 and the primary system processor 75 within a private, secure, local communication network that may be implemented wired or wirelessly, and/or a sensor-specific network through which sensors 71, 72, 73 may communicate with one another and/or with dedicated other devices. Alternatively, as shown in FIG. 3, one or more sensors 71, 72, 73 may communicate via a common local network 70, such as a Wi-Fi, Thread or other suitable network, with each other and/or with a controller 160 and primary system processor 75. Alternatively or in addition, sensors 71, 72, 73 may communicate directly with a remote system 74.

As previously alluded to, the smart-home environment including the sensor network shown in FIG. 3 may include a plurality of premises management devices, including intelligent, multi-sensing, network-connected devices, that can integrate seamlessly with each other and/or with a central server or a cloud-computing system (e.g., controller 73 and/or remote system 74) to provide home-security and smart-home features. Such devices may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72, 73 shown in FIG. 3. These premises management devices may be used by the disclosed security system, but may also have a separate, primary function.

For example, a smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72, 73 shown in FIG. 3, and the controller 160 may control the HVAC system (not shown) of the structure. However, unusual changes in temperature of a given room may also provide data that can supplement a determination of whether a situation is a security concern, for example, detecting a rapid drop in temperature in a given room due to a broken in window.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72, 73 shown in FIG. 3, and the controller 160 may control an alarm system to provide a visual and/or audible alarm to the user of the smart-home environment. However, the speaker of the hazard detector can also be used to announce security related messages, as will be described below.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 160. However, the detection of an approach of an unknown party can provide data to the disclosed security system to supplement determining whether the presence of the unknown party is a security concern.

On the other hand, a smart-home environment may include one or more intelligent, multi-sensing, network-connected entry detectors (e.g., "smart entry detectors") that are specifically designed to function as part of a security subsystem. Such detectors may be or include one or more of the sensors 71, 72, 73 shown in FIG. 3. The smart entry detectors may be disposed at one or more windows, doors, and other entry points of the smart-home environment for detecting when a window, door, or other entry point is opened, broken, breached, and/or compromised. The smart entry detectors may generate a corresponding signal to be provided to the controller 160, primary system processor 75, and/or the remote system 74 when a window or door is opened, closed, breached, and/or compromised. In some embodiments of the disclosed security system, the alarm, which may be included with controller 160 and/or coupled to the network 70 may not arm unless all smart entry detectors (e.g., sensors 71, 72, 73) indicate that all doors, windows, entryways, and the like are closed and/or that all smart entry detectors are armed.

The smart thermostats, the smart hazard detectors, the smart doorbells, the smart entry detectors, and other premise management devices of a smart-home environment (e.g., as illustrated as sensors 71, 72, 73 of FIG. 3) can be communicatively connected to each other via the network 70, and to the controller 160, primary system processor 75, and/or remote system 74.

One or more users can control one or more of the network-connected smart devices in the smart-home environment using a network-connected computer or portable electronic device. In some examples, some or all of the users (e.g., individuals who live in the home) can register their mobile device, token and/or key FOBs with the smart-home environment (e.g., with the controller 160). Such registration can be made at a central server (e.g., the controller 160 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment may "learn" who is a user (e.g., an authorized user) and permit the electronic devices associated with those individuals to control the network-connected smart devices of the smart-home environment (e.g., devices communicatively coupled to the network 70), in some embodiments including sensors used by or within the smart-home environment. Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

Figure 4:
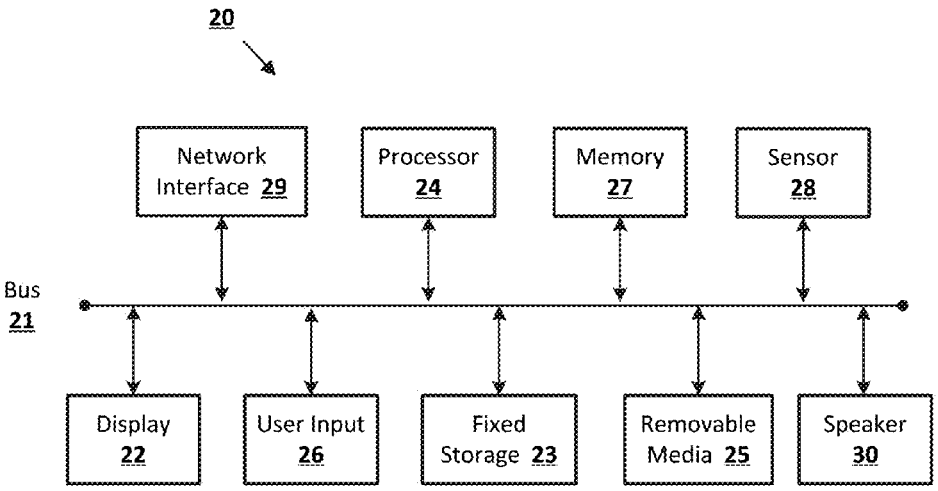
FIG. 4 shows an example computing device according to an embodiment of the disclosed subject matter.

FIG. 4 shows an example computing device 20 suitable for implementing certain components that are a part of embodiments of the disclosed security system. The computing device 20 may be used to implement, for example, the controller device 160 or a premises management device including sensors as disclosed above. The computing device 20 may be constructed as a custom-designed device or may be, for example, a special-purpose desktop computer, laptop computer, or mobile computing device such as a smart phone, tablet, personal data assistant, wearable technology, or the like.

The computing device 20 may include a bus 21 that interconnects major components of the computing device 20. Such components may include a central processor 24; a memory 27, such as Random Access Memory (RAM), Read Only Memory (ROM), flash RAM, or the like; a sensor 28, which may include one or more sensors as previously discussed herein; a user display 22, such as a display screen; a user input interface 26, which may include one or more user input devices such as a keyboard, mouse, keypad, touch pad, turn-wheel, and the like; a fixed storage 23 such as a hard drive, flash storage, and the like; a removable media component 25 operable to control and receive a solid-state memory device, an optical disk, a flash drive, and the like; a network interface 29 operable to communicate with one or more remote devices via a suitable network connection; and a speaker 30 to output an audible communication to the user. In some embodiments the user input interface 26 and the user display 22 may be combined, such as in the form of a touch screen.

The bus 21 allows data communication between the central processor 24 and one or more memory components 25, 27, which may include RAM, ROM, and other memory, as previously noted. Applications resident with the computing device 20 are generally stored on and accessed via a computer readable storage medium.

The fixed storage 23 may be integral with the computing device 20 or may be separate and accessed through other interfaces. The network interface 29 may provide a direct connection to the premises management system and/or a remote server via a wired or wireless connection. The network interface 29 may provide such connection using any suitable technique and protocol, as will be readily understood by one of skill in the art, including digital cellular telephone, WiFi, Thread, Bluetooth®, near-field, and the like. For example, the network interface 29 may allow the computing device 20 to communicate with other components of the premises management system, other computers via one or more local, wide-area, or other communication networks, as described in further detail herein.

Figure 5:
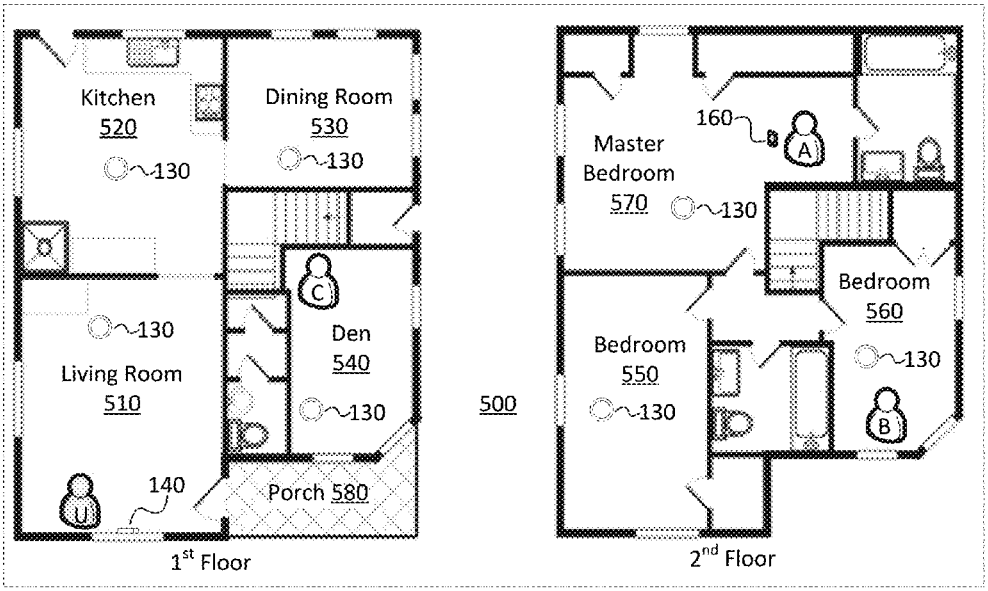
FIG. 5 shows an example layout of a house including a configuration of a premises management system implementing the a security system according to an embodiment of the disclosed subject matter.

FIG. 5 shows an example layout of a two-floor house 500 including a configuration of a premises management system installed therein implementing the disclosed security system. The house 500 includes a living room 510, kitchen 520, dining room 530, den 540, bedroom 550, bedroom 560, master bedroom 570, and porch 580.

Referring to FIGS. 1 and 5, the system 100 installed in the house 500 may include network-connected hazard detection units 130 installed throughout the house 500, network-connected entry detection units 140 installed at windows and doors throughout the house, and a network-connected controller device 160. For simplicity and to avoid unnecessary clutter, only one entry detection unit 140 is illustrated, i.e., in the living room 510, but it should be understood that entry detection units 140 may be installed at multiple windows and/or doors throughout the house 500, and furthermore that other premise management devices (e.g., smart thermostats, smart doorbells, etc.) as described above may be installed as part of the system 100.

Authorized occupants A, B, and C may be occupying the house 500, with A and B in the bedrooms 570 and 560 on the second floor and with C in the den 540 on the first floor. At a point in time, for example, 11:03:00 PM, an unauthorized party U may enter the house 500 through a window in the living room 510. The system 100 may detect the entry of the unauthorized party U based on sensor data from the entry detection unit 140. The system may identify the entry as being a security breach in any of various ways, for example, based on data that indicates the manner of entry was forced or unusual, data that indicates the timing and location of entry was unusual, or the current mode of system 100 combined with the failure of the unauthorized party to enter a validation code, etc. After the system 100 identifies the entry as a security breach, the system 100 may activate an alarm mode or switch to a heightened alarm state.

Upon activating an alarm mode or switching to a predetermined level of a heightened alarm state, the system 100 may initiate storing sensor data that indicates a location of the unauthorized party U within the house 500. By extension, where possible, the system may store a log of location data for each detectable individual in the house 500. For example, this may be accomplished by leveraging sensor data from the hazard detection units 130 and/or other components of the system 100 that may include an IR sensor, temperature sensor, microphone, camera, or the like which may obtain data that can be used to determine whether an individual is nearby or present in the room with the respective component.

FIG. 6 shows an example log of location data. At the time of the security breach, 11:03:00 PM, the system 100 stores a location for each detectable individual in the premises. At a predetermined interval, the system 100 stores an updated location for each detectable individual. Operating under a five-second interval, at time 11:03:05 PM locations are updated in the log, capturing data that indicates individuals A, B, and U are detected to have remained in their previous location while individual C is no longer detected in his/her previously stored location. The length of the update interval may be configured as a system setting that may be adjusted by an authorized user.

Upon activating the alarm mode or switching to the predetermined level of a heightened alarm state, the system 100 may also audibly announce the location of the unauthorized party. In addition, with each updated logging of location data, the system 100 may audibly announce an update of the location of the unauthorized party U, thereby providing a warning to authorized occupants of which area to avoid. Accordingly, at time 11:03:00 PM the system 100 may audibly announce, "Intruder in living room." The announcement may be executed through any premises management devices of the system 100 that are equipped with speakers. For example, referring to FIG. 5, the announcement may be executed through one or more of the hazard detection units 130 and/or through the control device 160. The authorized user may control the settings of how widespread or narrow the announcement is executed throughout the house 500. For example, the location of the unauthorized party could be announced throughout the entire house 500. This will notify all occupants and warn the unauthorized party that it has been detected and tracked, which may increase the deterring effect of the alarm on the unauthorized party and hasten a swift departure. In other settings the system 100 may be configured to announce the location in select rooms of the house 500 (e.g., master bedroom 570 or any room in which the control device 160 is present), or only through the control device 160 itself or a registered mobile device such as a cell phone, tablet computer, personal data assistant or wearable technology.

Figure 7:
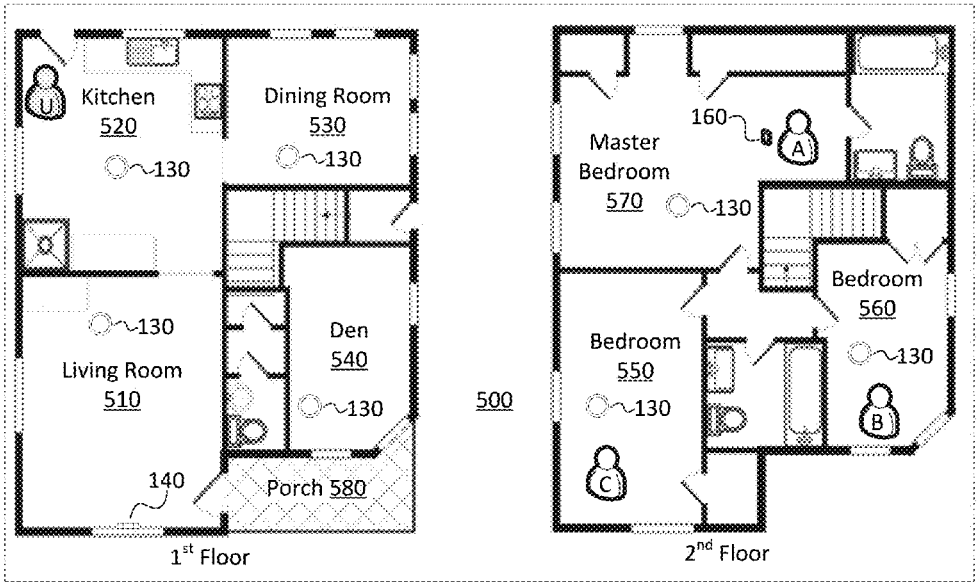
FIG. 7 shows another example layout of a house including a configuration of a premises management system implementing the a security system according to an embodiment of the disclosed subject matter.

FIG. 7 shows the house 500 at time 11:03:10. The unauthorized party U has moved through the living room 510, into the kitchen 130, and is approaching the back door out of the house 500. Meanwhile, authorized party C, having been warned of the location of the unauthorized party, has left the den 540 and moved up to the second floor bedroom 550 in order to avoid confrontation. These movements may be captured by the system 100, as shown in the log of FIG. 8.

The tracking of the individuals may be executed using any of the sensors mentioned above or other types of sensors/detectors, including cameras, microphones, motion detectors, temperature detectors and the like. Various techniques such as image recognition, audio recognition and the like may be used to track each locations on an individual basis. The tracking log may be accessible to the authorized user via the control device 160 or via a system portal, for example, accessed through a computer or mobile computing device. Furthermore, the system 100 may be configured to transmit the tracking log to a third party, such as a monitoring service or law enforcement agency in order to aid in apprehending the unauthorized party and avoid friendly fire incidents. As such, in the event that the unauthorized party has not been frightened away, law enforcement officials may arrive with some indication of where the unauthorized party entered the premises, the path the unauthorized party traversed inside, and the present location of the unauthorized party, as well as an idea of where the authorized parties in the premises are situated.

Figure 9:
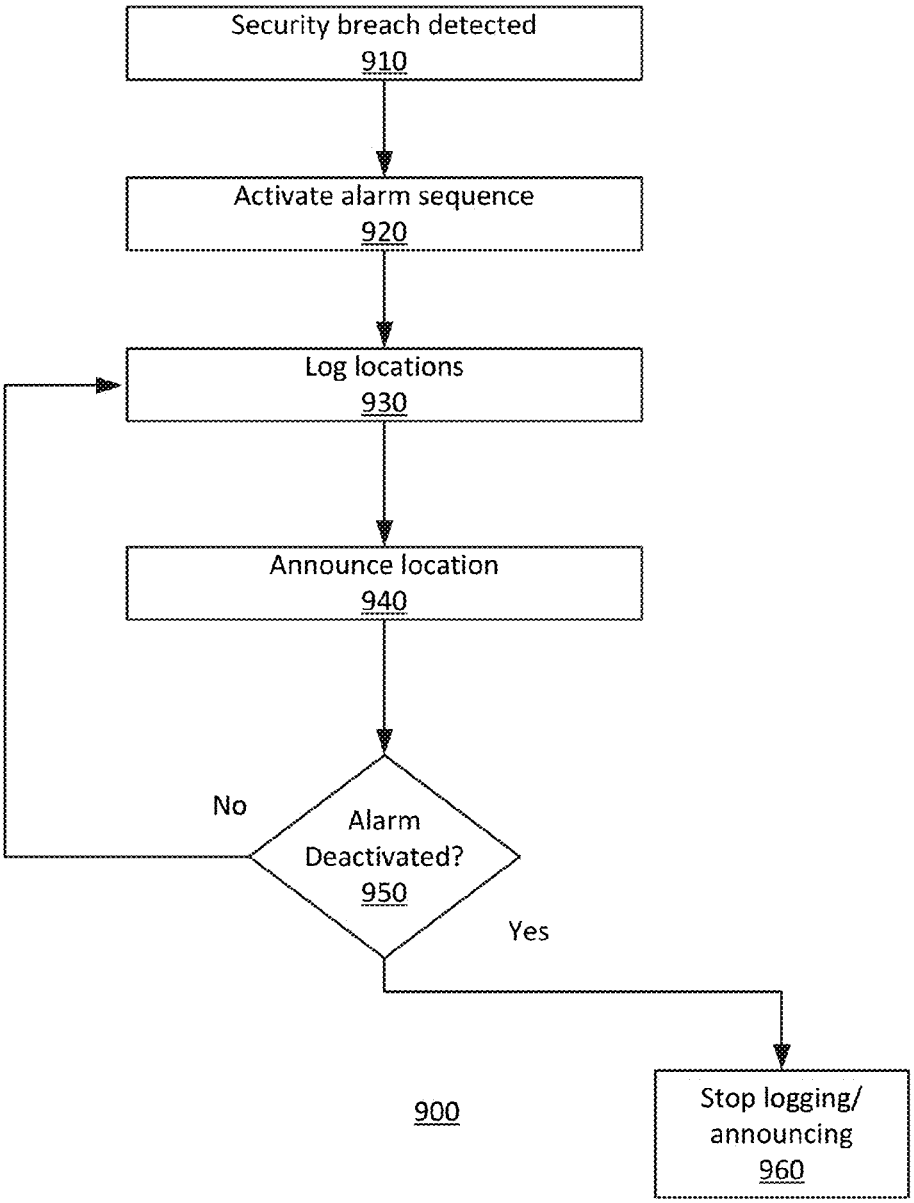
FIG. 9 shows a flowchart 900 of an embodiment of operations of a security system according to an embodiment of the disclosed subject matter.

FIG. 9 shows a flowchart 900 of an embodiment of operations of the disclosed security system. At operation 910 a security breach is detected. At operation 920 an alarm sequence is activated. The alarm sequence could include, for example, notifying a third party monitoring service, notifying law enforcement services, and/or changing an operational state of the system.

At operation 930 the detected location of the unauthorized party and the locations of the detectable authorized parties present within the premises are stored in a log. Authorized parties may be detected based on any number of factors or combination of factors, including possession of a verified token or key FOB, possession of a system-recognizable mobile phone or wearable technology, image recognition, and/or presence detected within the premises during a secure state of the premises.

At operation 940 the location of the unauthorized party is announced. The announcement may be an audible announcement provided throughout the premises, to select areas within the premises, or to select devices, such as a control device or a mobile phone. The announcement may further be transmitted via electronic means such as text message or email and sent to multiple authorized parties simultaneously.

At operation 950 the alarm state is checked to see whether the alarm has been deactivated, indicating that the situation is under control. If the alarm has been deactivated, then the process ends at operation 960, individual locations are no longer logged and the location of the unauthorized party is no longer announced. If the alarm has not been deactivated, operations 930 and 940 are repeated at a set interval until the alarm is deactivated. The intervals may be, for example, a preset static length of time, adjustable as a system setting by an authorized user, or a dynamic length time that decreases/increases as the situation progresses, or a variable time length triggered by an event, such as the detection of the unauthorized party moving from one location to another location.

In situations in which the systems discussed here collect information about users, or may make use of information, the users may be provided with an opportunity to control whether programs or features collect or store user information (e.g., information about a user's social network, social actions or activities, profession, a user's preferences, or a user's current location). Certain features that may collect information, for example, for identifying authorized users by face recognition, video tracking, etc., may be disabled by an authorized user. In addition, certain data may be treated in one or more ways before it is stored or used, so that personally identifiable information is removed. For example, specific information about a user's location within the premises may be treated so that no personally identifiable information can be determined for the user, or a user's greater geographic location may be omitted or generalized where premises location information is obtained (such as to a city, ZIP code, or state level), so that an exact location of a user cannot be determined. In situations in which authorized users are identified, such identity may optionally be limited to simply being an anonymous authorized user without any specific personal identification data. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein. Furthermore, the user may have the option to purge the logs manually or automatically for user privacy.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A system comprising:

a plurality of sensors to detect entry into a premises by an unauthorized party and to detect a location of the unauthorized party through at least a portion of the premises;

a storage component to store the detected location of the unauthorized party in a log;

an audio component to audibly announce the detected location of the unauthorized party; and a processor to control the audio component to announce the detected location at predetermined intervals or upon a change in the detected location of the unauthorized party.

2. The system of claim 1, wherein the processor processes data from the sensors to detect the entry of the unauthorized party into the premises and to identify the unauthorized party as being unauthorized to enter the premises.

3. The system of claim 1, wherein each of the plurality of sensors includes at least one selected from: a motion sensor, a camera, a light sensor, and a temperature sensor.

4. The system of claim 1, wherein the audio component is configured to audibly announce the detected location such that the announcement may be heard throughout at least a portion of the premises.

5. The system of claim 4, wherein the at least a portion of the premises is determined based on a setting selected by an authorized party.

6. The system of claim 1, wherein the audio component is configured to audibly announce the detected location such that the announcement may be heard through a system control device.

7. The system of claim 6, wherein the system control device is a mobile computing device selected from a group consisting of: a cell phone, a laptop computer, a tablet computer, and a personal data assistant.

8. The system of claim 1, wherein the processor processes data from the plurality of sensors to detect locations of authorized parties within the premises after the detected entry of the unauthorized party.

9. The system of claim 8, wherein the processor determines that any party already present within the premises when the entry of the unauthorized party is detected is an authorized party.

10. The system of claim 8, further comprising a wireless communication interface, wherein the processor determines that any party that enters the premises with an authorized token that communicates with the system via the wireless communication interface is an authorized party.

11. The system of claim 10, wherein the authorized token comprises a wireless communication device configured to transmit an authorization code.

12. The system of claim 1, further comprising a network interface configured to upload the stored detected location to an external server.

13. A method of operating a security system, comprising:

detecting an entry of an unauthorized party into a premises;

detecting a location the unauthorized party in at least a portion of the premises;

storing a log of the detected location of the unauthorized party; and audibly announcing the detected location of the unauthorized party at predetermined intervals or upon a change in the detected location of the unauthorized party.

14. The method of claim 13, wherein detecting the entry of the unauthorized party into the premises comprises:

detecting the entry of a party into the premises; and identifying the party as being unauthorized to enter the premises.

15. The method of claim 13, wherein the entry of the unauthorized party is detected using a plurality of sensors including motion sensors, cameras, light sensors, and temperature sensors.

16. The method of claim 13, wherein audibly announcing the location comprises audibly announcing the detected location such that the announcement may be heard throughout at least a portion of the premises.

17. The method of claim 16, wherein the at least a portion of the premises is determined based on a setting selected by an authorized party.

18. The method of claim 13, wherein audibly announcing the location comprises audibly announcing the detected location such that the announcement may be heard through a system control device.

19. The method of claim 18, wherein the system control device is a mobile computing device selected from a group consisting of: a cell phone, a laptop computer, a tablet computer, and a personal data assistant.

20. The method of claim 13, further comprising detecting locations of authorized parties within the premises after the detected entry of the unauthorized party.

21. The method of claim 20, wherein any party that is already present within the premises when the entry of the unauthorized party is detected is determined to be an authorized party.

22. The method of claim 20, wherein any party that enters the premises with an authorized token detected is determined to be an authorized party.

23. The method of claim 22, wherein the authorized token comprises a wireless communication device configured to broadcast an authorization code.

24. The method of claim 13, further comprising uploading the stored detected location to an external server.

* * * * *